US005640784A

United States Patent [19]

Rocheleau

[11] Patent Number: 5,640,784

[45] Date of Patent: Jun. 24, 1997

[54] NON-CONTACT FLOTATION WEB GUIDE/ DRYER

[75] Inventor: Michael O. Rocheleau, Sobieski, Wis.

[73] Assignee: W.R. Grace & Co.-Conn., New York, N.Y.

[21] Appl. No.: 408,663

[22] Filed: Mar. 21, 1995

[51] Int. Cl.[6] ..... F26B 21/06

[52] U.S. Cl. ..... 34/541; 34/571; 34/621

[58] Field of Search ..... 34/524, 541, 548, 34/566, 561, 570, 571, 579, 582, 588, 94, 611, 614, 618, 619, 621, 623, 662, 195, 223, 230, 233; 74/416, 417

[56] References Cited

U.S. PATENT DOCUMENTS 5,129,275 7/1992 Park ..... 74/417

5,134,788 8/1992 Stübbe et al. ..... 34/524

*Primary Examiner*—John M. Sollecito

*Assistant Examiner*—Steve Gravini

*Attorney, Agent, or Firm*—Craig K. Leon; Kevin S. Lemack; William L. Baker

[57] ABSTRACT

Drying apparatus including pressure control of air supply feeding an air bar and subsequently impinging upon a web, so as to avoid or compensate for web shift without disturbing the cushion pressure and flotation techniques necessary for adequate web flotation and drying, as well as a method of regulating the pressure of supply air to such air bars. A damper or valve is positioned in the header system between first and second ducts feeding each air bar. Proper adjustment of the damper regulates the pressure of supply air in each duct, and compensates for web shift or minimizes or prevents web shift from occurring.

11 Claims, 5 Drawing Sheets

NON-CONTACT FLOTATION WEB GUIDE/ DRYER

BACKGROUND OF THE INVENTION

The present invention relates to a dryer header system incorporating a web guide, typically for use in web flotation drying applications.

Conventional air bars and air duct delivery systems are designed to obtain even air flow to the web occurs notwithstanding minor disturbances in duct delivery systems. Uneven air distribution is generally considered to be undesirable, since the same can result in drying streaks on the web, improper clearance of the web from the air bar surface, and/or improper flotation of the web (e.g., web flutter). Thus, in a conventional air bar having more than one air receiving port in communication with a duct delivery system, if one port is supplied air at a pressure different from that at which another port is supplied air, the air bar is designed so that the two different air supplies mix in an internal chamber of the air bar, allowing even pressure air delivery to the web.

In addition, as a floating web approaches the edge of an air bar, the pressure pad which allows web flotation collapses, causing web flutter. This phenomenon is similar to the edge of an unattached sail on a sail boat, and in flotation drying, is undesirable. Accordingly, webs are typically positioned about 1–4 inches from the air bar edges.

It would, however, be desirable to continuously control or compensate for web shift occuring during the drying operation, regardless of the cause thereof. It is therefore an object of the present invention to compensate for such web shift.

It is a further object of the present invention to provide apparatus to control the pressure differential between two ducts feeding a given air bar.

SUMMARY OF THE INVENTION

The problems of the prior art have been overcome by the instant invention, which provides for pressure control of air supply feeding an air bar and subsequently impinging upon a web, so as to avoid or compensate for web shift without disturbing the cushion pressure and flotation techniques necessary for adequate web flotation and drying. More specifically, a damper or valve is positioned in the header system feeding first and second ducts, which ducts in turn feed each air bar. Proper adjustment of the damper regulates the pressure of supply air in each duct, and compensates for web shift or minimizes or prevents web shift from occurring.

DETAILED DESCRIPTION OF THE INVENTION

Figure 1:
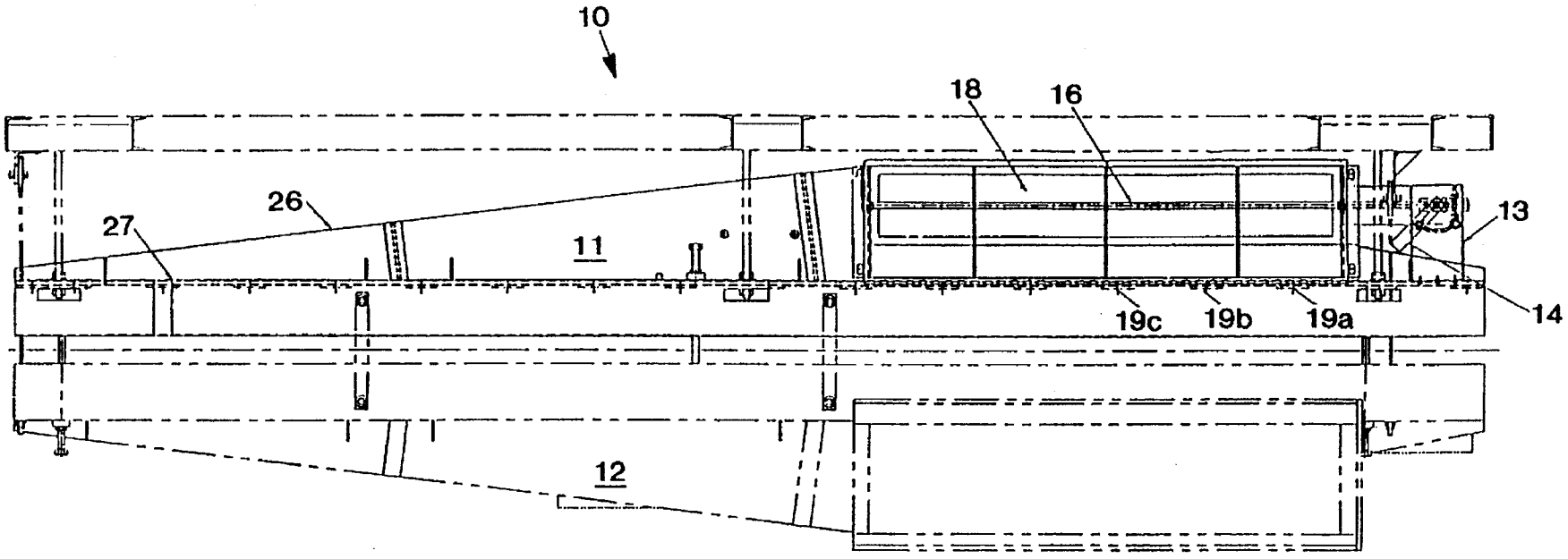
FIG. 1 is a side cross-sectional view of a header assembly having an adjustable damper in accordance with the present invention.
Figure 2:
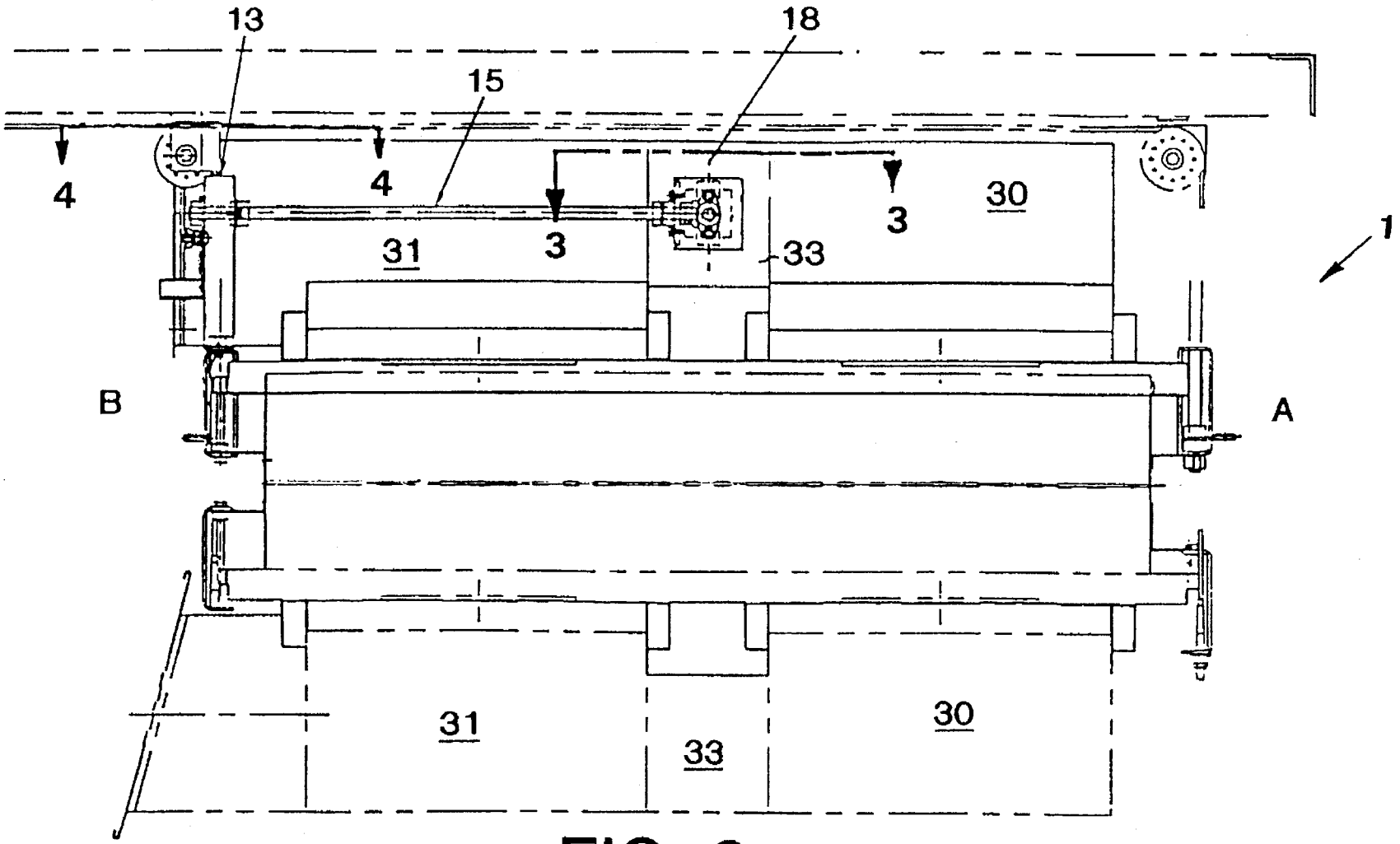
FIG. 2 is a front cross-sectional view of the header system of FIG. 1 in accordance with the present invention.

Turning now to FIGS. 1 and 2, there is shown generally at 10 an upper header assembly 11 and a lower header assembly 12, each adapted to receive and be in air flow communication with a plurality of air bars or nozzles (not shown) via a pair of finger ducts 30, 31 for floatingly drying a running web. Although the present invention is not limited to any particular type of air bar used, preferably the air bar is of the Coanda type such as the Hi-Float air bar commercially available from W. R. Grace & Co.-Conn. Each air bar has a pair of air receiving ports adapted to be sealingly connected to the header assembly 11 or 12 via ports 19*a*, 19*b*, 19*c*, etc. in each of the finger ducts 30, 31. Each air bar extends over and is fed by two finger ducts, and thus each air bar includes two ports, each corresponding to a port in each of the two finger ducts.

Each upper and lower header system includes two finger ducts 30, 31 which directly feed the air bars as described above. The finger ducts 30 are proximal to the gear side A of the dryer, and the finger ducts 31 are proximal to the operator side B of the dryer. Located behind each pair of finger ducts 30 and 31 is a crossover duct 33. The crossover duct 33 is in communication with a supply fan (not shown) which provides pressurized air to the crossover duct, which in turn provides pressurized air to the finger ducts 30, 31 and ultimately to the plurality of air bars.

Figure 3:
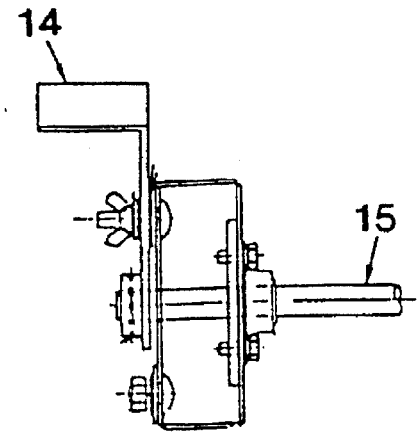
FIG. 3 is a cross-sectional view of a portion of the damper actuating assembly taken along line F—F of FIG. 2.
Figure 4:
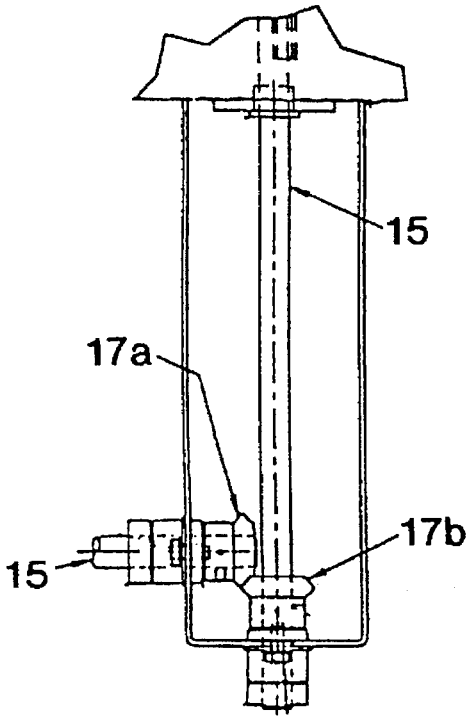
FIG. 4 is a cross-sectional view of another portion of the damper actuating assembly taken along line E—E of FIG. 2.
Figure 6:
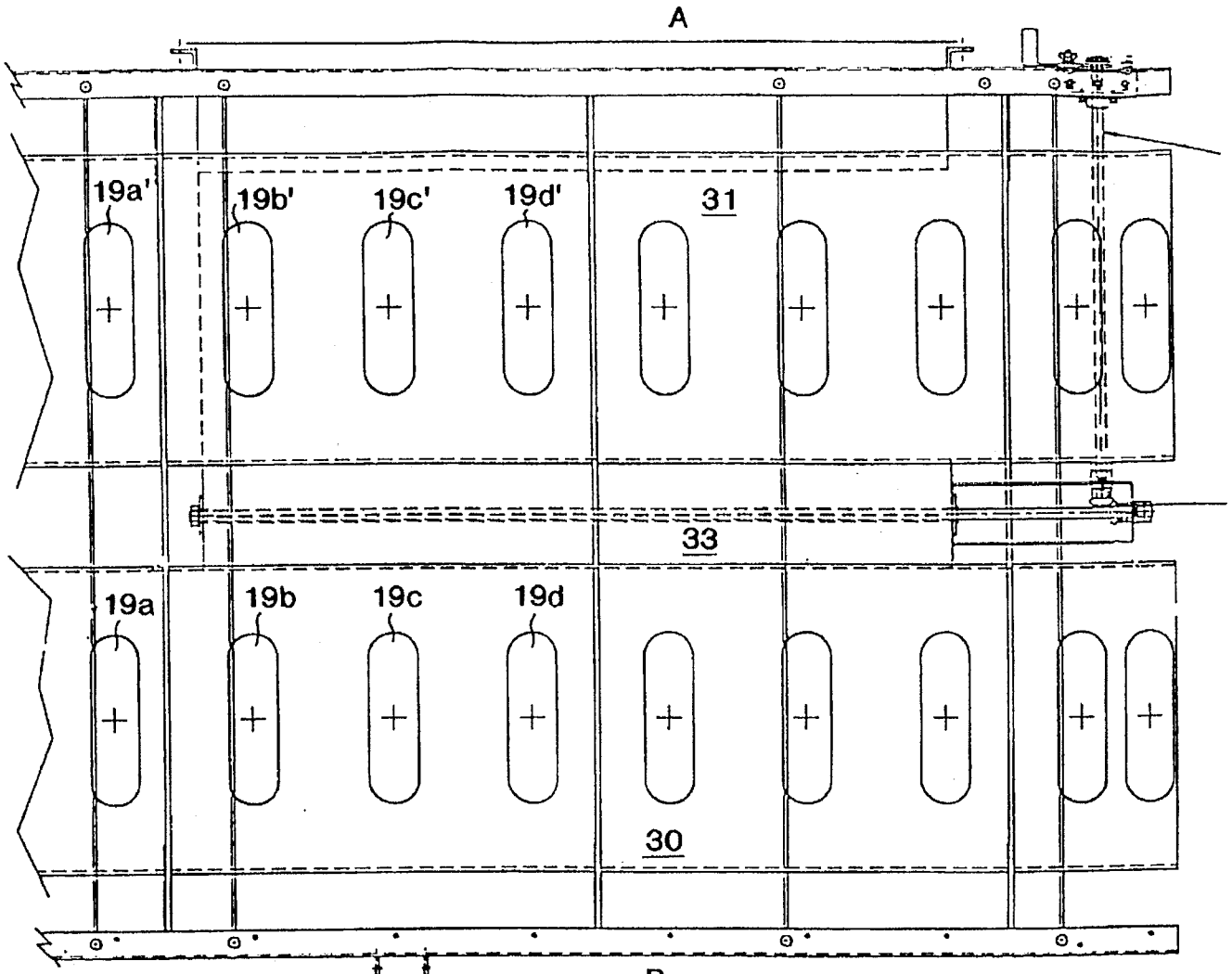
FIG. 6 is a bottom cross-sectional view of the upper header assembly of FIG. 1 in accordance with the present invention.

Located on the operator side B of the dryer and accessible to the operator is damper actuator 13 having a moveable lever 14. As best seen in FIGS. 3 and 6, the lever 14 is coupled to a first rigid round rod 15 which extends into the dryer enclosure. Movement of the lever 14 causes rotational movement of the first round rod 15. At its distal end, the first round rod 15 is coupled via miter gears 17*a*, 17*b* to a second round rod 16 positioned perpendicularly to the first round rod 15, as best seen in FIG. 4. The aforementioned rotational motion of the first round rod 15 causes a similar movement of the second round rod 16 via the miter gears 17*a*, 17*b*.

Figure 5:
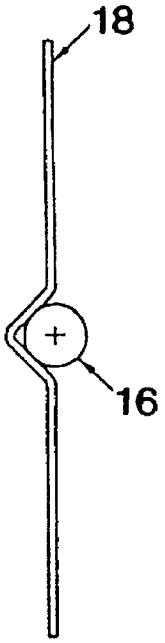
FIG. 5 is a cross-sectional view of the damper vane shown coupled to the damper actuating assembly in accordance with the present invention.

Coupled to second round bar 16 is a damper vane 18, which is preferably a low carbon tabulated sheet. A V-shaped groove is formed along the length of the damper vane 18, as shown in FIG. 5, to accommodate the round bar 16 and to which it is secured such as by welding. Rotational movement of round bar 16 causes rotational movement of damper vane 18 secured to it. A damper vane 18 is positioned in each crossover duct 33 which is in air supplying communication with finger ducts 30 and 31. When the damper vane 18 is in the fully open or horizontal position, the supply of air to the crossover duct 33 and subsequently to finger ducts 30 and 31 is substantially unaffected by the damper vane 18. However, in the event of web shift, movement of the damper vane 18 towards vertical will cause a pressure differential between finger duct 30 and finger duct 31, which compensates for the web shift. Accordingly, the amount of air supplied to each finger duct 30 and 31 can be regulated based upon the occurrence of web shift, either observed manually or sensed automatically.

Figure 7:
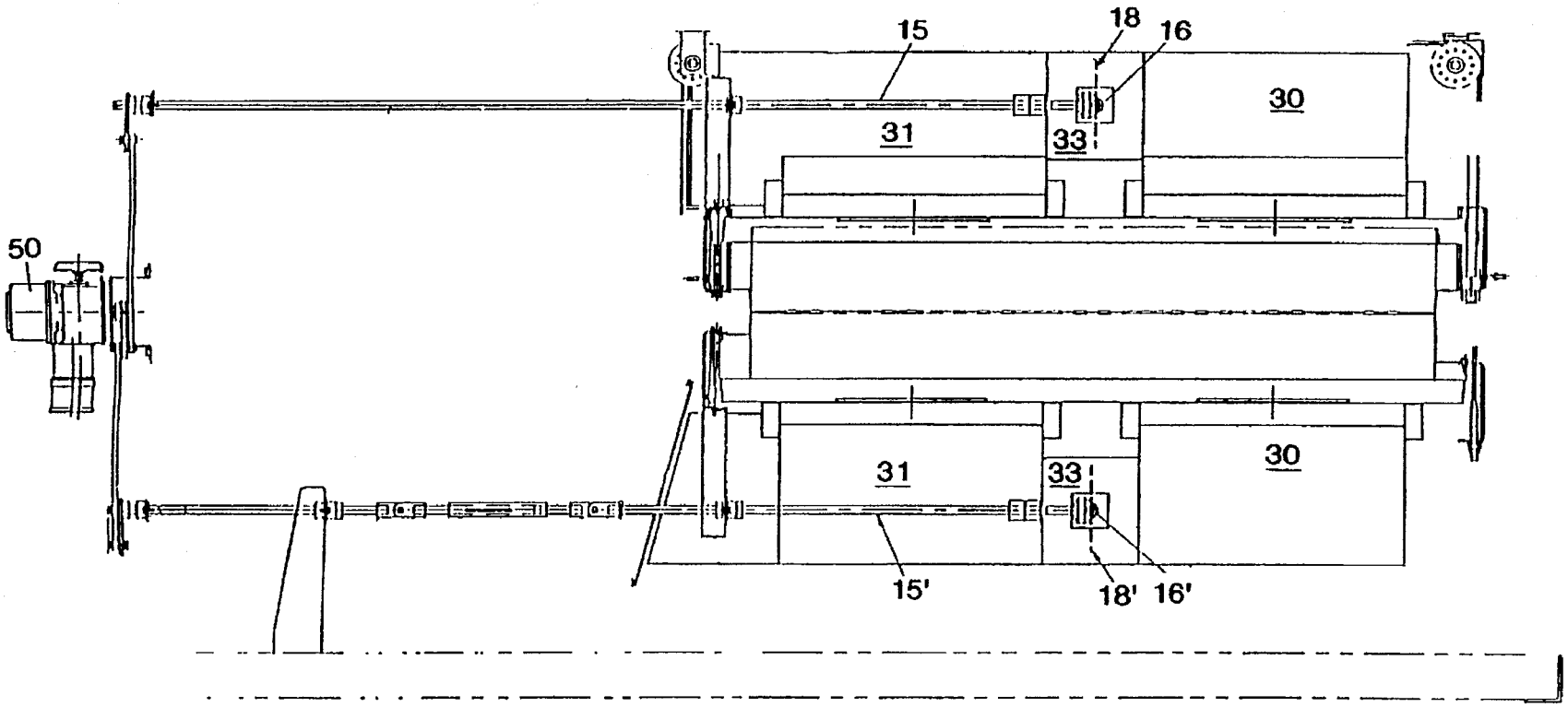
FIG. 7 is a front cross-sectional view of the header system of FIG. 1 in accordance with another embodiment of the present invention.

It should be understood by those skilled in the art that the respective relative positions of the first and second round rods 15, 16 are dictated by the location of the ducts in the dryer enclosure and by the location of the actuating assembly therefor; the actuating assembly including lever 14 should be readily accessible to the operator. It should be also understood by those skilled in the art that one or both of the upper and lower header systems can include a damper assembly, and that they can be individually controlled or can be controlled with a single actuator. For example, FIG. 7 shows the embodiment wherein both the upper and lower header systems are equipped with a damper assembly. Thus, upper header system includes damper vane 18 coupled to a rigid round rod 16, which in turn is coupled to rigid round rod 15 as in the embodiment of FIG. 2. Similarly, lower header system includes a damper vane 18' coupled to a rigid round rod 16', which in turn is coupled to rigid round rod 15'. Each rod 15, 15' is coupled to an actuator 50 as shown.

The damper assembly can be driven automatically using conventional actuator motors, which respond either to manual input or to an electrical signal generated as a result of web shift. For example, a conventional web guide optical sensor, such as an infrared sensor, can be used to sense when the web shifts. Upon the occurrence of a web shift requiring correction, such as a 30% or greater shift, the infrared sensor can send a signal to the actuator motor or motors, which causes movement of the dampers, preferably in steps, until the shift is less than the set point value, such as less than 30%. The upper and lower dampers can be moved as a result of the same signal, or can be moved independently by receiving separate signals.

Alternatively, the dampers can be manually controlled. The operator would watch the web guide indicator and manually control a switch that activates the actuator. The switch would be released when the web guide indicator indicates that correction of web shift is no longer necessary.

What is claimed is:

1. Dryer housing for floatingly drying a traveling web, said housing comprising:

an upper header assembly comprising a pair of upper finger ducts for feeding air to a plurality of upper air bars for floatingly drying a traveling web;

a plurality of upper air bars each in air-receiving communication with said pair of upper finger ducts;

an upper crossover duct in air receiving communication with a supply fan and in air supplying communication with said pair of upper finger ducts; and upper damper means in said upper crossover duct for controlling the differential pressure in said pair of upper finger ducts whereby web shift can be compensated; said dryer housing further comprising a lower header assembly comprising a pair of lower finger ducts for feeding air to a plurality of lower air bars for floatingly drying the traveling web;

a plurality of lower air bars in air-receiving communication with said pair of lower finger ducts:

a lower crossover duct in air receiving communication with a supply fan and in air supplying communication with said pair of lower finger ducts:

lower damper means in said lower crossover duct for controlling the differential pressure in said pair of lower finger ducts, whereby web shift can be compensated.

2. The dryer housing of claim 1, wherein said upper damper means comprises a damper vane rotatingly secured in said upper crossover duct and operative to regulate the pressure of supply air in said pair of upper ducts in communication with said plurality of upper air bars.

3. The dryer housing of claim 1, wherein said lower damper means comprises a damper vane rotatingly secured in said lower crossover duct and operative to regulate the pressure of supply air in said pair of lower ducts in communication with said plurality, of lower air bars.

4. The dryer housing of claim 2, further comprising means for actuating said damper vane secured in said upper crossover duct, said actuating means comprising a first rod extending into said dryer housing and rotatingly coupled to a second rod secured to said damper vane.

5. The dryer housing of claim 3, further comprising means for actuating said damper vane secured in said lower crossover duct, said actuating means comprising a first rod extending into said dryer housing and rotatingly coupled to a second rod secured to said damper vane.

6. A web dryer comprising: an upper header assembly and a lower header assembly each having a gear side and an operator side, each said header assembly comprising a pair of finger ducts each adapted to receive and be in air flow communication with a plurality of air bars, each of said finger duct pairs having a finger duct proximal to said gear side of the dryer and a finger duct proximal to the operator side of the dryer; each said assembly further comprising a plurality of air bars mounted on said pairs of finger ducts and in air flow communication therewith for floatingly supporting a web traveling between said upper and lower head assemblies; each of said header assemblies further comprising a crossover duct in air flow communication with each of said paired finger ducts and operative to feed air thereto from an air supply fan; and said header assemblies further comprising a damper for controlling the differential pressure in and between said pairs of finger ducts whereby web shift between said dryer gear side and operator side can be controlled.

7. The web dryer of claim 6 further comprising a damper vane rotatingly secured in said crossover ducts.

8. The web dryer of claim 7 wherein said damper vane is operative to move from a first horizontal position to a second vertical position, whereby the differential pressure in and between said pairs of finger ducts are controlled.

9. The web dryer of claim 8 wherein said damper vane is controlled by actuating means comprising a rod rotatingly coupled to said damper vane.

10. The web dryer of claim 8 wherein said actuating means is responsive to an electrical signal generated as a result of web shift.

11. The web dryer of claim 10 wherein said air bars comprise Coanda bars.

* * * * *